US006641131B2

(12) United States Patent
Stöhr et al.

(10) Patent No.: US 6,641,131 B2
(45) Date of Patent: Nov. 4, 2003

(54) HANDLING DEVICE, IN PARTICULAR FOR HANDLING BOARDS AND FOILS

(75) Inventors: Eberhard Stöhr, Esslingen (DE); Peter Löbelenz, Urbach (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/208,438

(22) Filed: Jul. 30, 2002

(65) Prior Publication Data

US 2003/0025264 A1 Feb. 6, 2003

(30) Foreign Application Priority Data

Jul. 31, 2001 (DE) ..... 201 12 633 U

(51) Int. Cl.[7] ..... B65H 3/40

(52) U.S. Cl. ..... 271/91; 271/90; 271/107; 271/11; 414/797; 294/65

(58) Field of Search ..... 271/90, 91, 107, 271/11; 414/797; 294/65

(56) References Cited

U.S. PATENT DOCUMENTS 3,591,228 A * 7/1971 Webb ..... 294/65
4,049,484 A * 9/1977 Priest et al. ..... 156/285
5,207,553 A * 5/1993 Konagai ..... 414/737
6,149,375 A * 11/2000 Hebrank ..... 414/737
6,481,953 B1 * 11/2002 Michel et al. ..... 414/796

FOREIGN PATENT DOCUMENTS

DE 29612442 U1 10/1996
GB 2300651 A 11/1996
JP 60179534 A * 9/1985 ..... F16D/47/06

* cited by examiner

*Primary Examiner*—Donald P. Walsh
*Assistant Examiner*—Kaitlin Joerger
(74) *Attorney, Agent, or Firm*—Hoffmann & Baron, LLP

(57) ABSTRACT

A handling device is proposed, in particular for handling boards and foils, with a number of suction grippers located in a plane. A suction plate (10) is provided which is made of a porous material or sintered material and a suction pressure can be applied to said suction plate, where said suction plate is equipped with openings (19) permitting passage of the suction grippers (18). In addition, positioning means (23) are provided so that in a first position setting, the suction grippers (18) extend past the suction surface (15) of the suction plate (10) and so that in a second position setting, the suction grippers (18) are set back into the openings (19) in such a manner that they no longer extend past the suction surface (15) of the suction plate (10).

10 Claims, 3 Drawing Sheets

HANDLING DEVICE, IN PARTICULAR FOR HANDLING BOARDS AND FOILS

BACKGROUND OF THE INVENTION

The invention pertains to a handling device, in particular for handling boards and foils, with a number of suction grippers located in a plane.

For example, in the manufacture of circuitboards, the circuitboards have to be positioned, turned and moved along to the next processing station during the various manufacturing processes. Positioning and movement of the circuitboards is effected in a known manner with a handling device in which a number of suction grippers are positioned in a plane. The suction grippers are lowered by means of a positioning device onto the particular circuitboard, and a suction pressure which is less than atmospheric pressure is then applied in order to secure the plate pneumatically to the handling device. The circuitboard can then be moved to the next desired working position by means of the positioning device.

However, this known handling device is suitable only for relatively stiff circuitboards with a board thickness of more than 0.5 mm, for example. Thinner circuitboards would necessarily be irreversibly deformed by the suction gripper itself, even at low suction pressure, so that thin circuitboards or conductor foils of this kind cannot be moved with this type of handling device.

For positioning and handling these thin boards or foils, air-permeable suction plates are known that generate a uniformly small suction pressure across their entire vacuum surface, so that thin boards or foils can be pneumatically placed on this suction surface and will not be deformed. However, these suction plates are not suitable for handling stiffer, more rigid boards, since these are not usually perfectly smooth due to their manufacture, and thus will not make a full-surface contact. Thus, these boards will not stick sufficiently to the suction plate.

Therefore, in practice, depending on the particular thickness of the board, the particular board under manufacture will be exposed to different handling devices, which may have to be replaced when switching the manufacture from thinner to thicker boards. This is very cumbersome and labor-intensive, in particular for rapid alternation in manufacture.

One problem of the present invention consists in the creation of a handling device which is equally suitable for handling thicker boards as well as thinner boards and foils.

This problem is solved according to this invention, in that a suction plate is provided which is made of a porous material or sintered material and to which a suction pressure can be applied, said suction plate being equipped with openings permitting the passage of the suction grippers, and in that positioning means are provided by means of which in a first position setting the suction grippers extend beyond the suction surface of the suction plate and by means of which in a second position setting, the suction grippers are moved back into the openings such that they no longer extend beyond the suction surface of the suction plate.

This handling device can be switched between the two position settings by a simple actuation of the positioning means, such that the first position setting will be used for handling thicker and stiffer boards, and the second position setting is used for handling very thin boards and foils, but without damaging them. Refitting the work stations is thus no longer necessary, and production can be switched very quickly and easily from thin boards and foils to thick boards and vice-versa. This changeover can occur under program control so that refitting downtimes are eliminated.

Favorable refinements and improvements to the handling device specified in claim 1 are possible due to the features presented in the dependent claims.

Preferably, control means are provided for supplying suction to the suction plate on the one hand, and to the suction grippers on the other hand, wherein the suction grippers are supplied with suction pressure only in the first position setting. In this manner, the suction grippers will be prevented from picking up the thin foil or board and pulling them into the openings and possibly damaging them, despite the fact that they are a certain distance away from them in the second position setting. Thus, in a first position setting, the suction pressure for the suction plate can be preferably switched off in order to prevent unnecessary usage. In addition, suction pressure can be saved in that, for smaller manipulated boards, only those suction grippers or only those regions of the suction plate which correspond essentially to the structure of the board will be supplied with suction pressure.

In yet another favorable design configuration of the invention, the suction plate is tightly connected with a suction pressure supply plate on the side facing away from the suction surface; said supply plate is provided with at least one suction pressure supply connector and this at least one suction pressure supply connector is connected to at least one planar cavity between the plates, and said cavity is formed by a recess in at least one of the plates. Due to the planar cavity or cavities, the largest possible surface area of the suction plate will be exposed to the suction pressure, which in turn means that the suction pressure application to the vacuum surface will be as uniform as possible. The suction pressure supply plate is also equipped with openings for the suction grippers which correspond to those in the suction pressure plate.

In this regard, it is preferable to design the positioning means at least as a pneumatic, variable-position actuator that is located between the suction plate and a retaining device for the suction grippers, where said retaining device has, in particular, one retaining plate. Thus, at least one actuator [of the positioning means] will be advantageously designed as a contraction element, which has a contraction tube extending between two head pieces and which experiences a length contraction when exposed to internal pressure. The structural and functional principle of contraction elements of this kind can correspond, for example, to that described in the brochure "Fluidic Muscle," or in EP 016 1750 B1, presented by the applicant. Due to this type of design of the (at least) one actuator, the positioning of the vacuum plate or of the suction gripper can be controlled very accurately, so that low costs and a simple, low-wear design will be additional advantages. With conventional actuators, height positioning over a range of 10 mm is possible, for example, in increments of one-tenth, but only with very great expense for the mechanism and control equipment, since there is a danger of kinking, in particular for large-surface vacuum plates of 600×800 mm, for instance.

In this regard, it is preferable to provide a stop device that limits movements of the plates toward each other in the direction of the first position setting, so that the projection of the suction gripper past the vacuum surface can be adjusted very precisely. For precision movement of the retaining device, a control device can be provided to guide the motion of the retaining device relative to the suction plate.

Particularly precise positioning of the contraction element or elements can be achieved by providing a proportional pressure control valve which is connected to the positioning means and which adjusts the internal pressure according to a specified setpoint. By means of an electrical, setpoint specification module, any particular analog setpoints can be adjusted, for example, by means of an integrated potentiometer. A digital determination of setpoints is also possible, of course.

Advantageously, a positioning device can be provided which positions the entire apparatus composed of the at least one or more suction plates, the retaining device for the suction grippers, and the at least one or more actuators, and which is designed to implement positioning movements at least in two directions in space, one of these corresponding to the direction of movement of the actuator. In addition to the forward movement of the board being handled, for example, from one workstation to the next, the vacuum plate can thus be moved very accurately in the vertical direction up to the thin board or foil to be grasped, merely by first performing a rough positioning by the positioning device and then effecting a precise approach of the vacuum plate by means of the contraction element or elements.

BRIEF DESCRIPTION OF THE DRAWINGS

One embodiment of the invention will be explained in greater detail with reference to the figures and to the following description. We have.

DETAILED DESCRIPTION OF THE PREFERRED EMBODIMENTS

Figure 1:
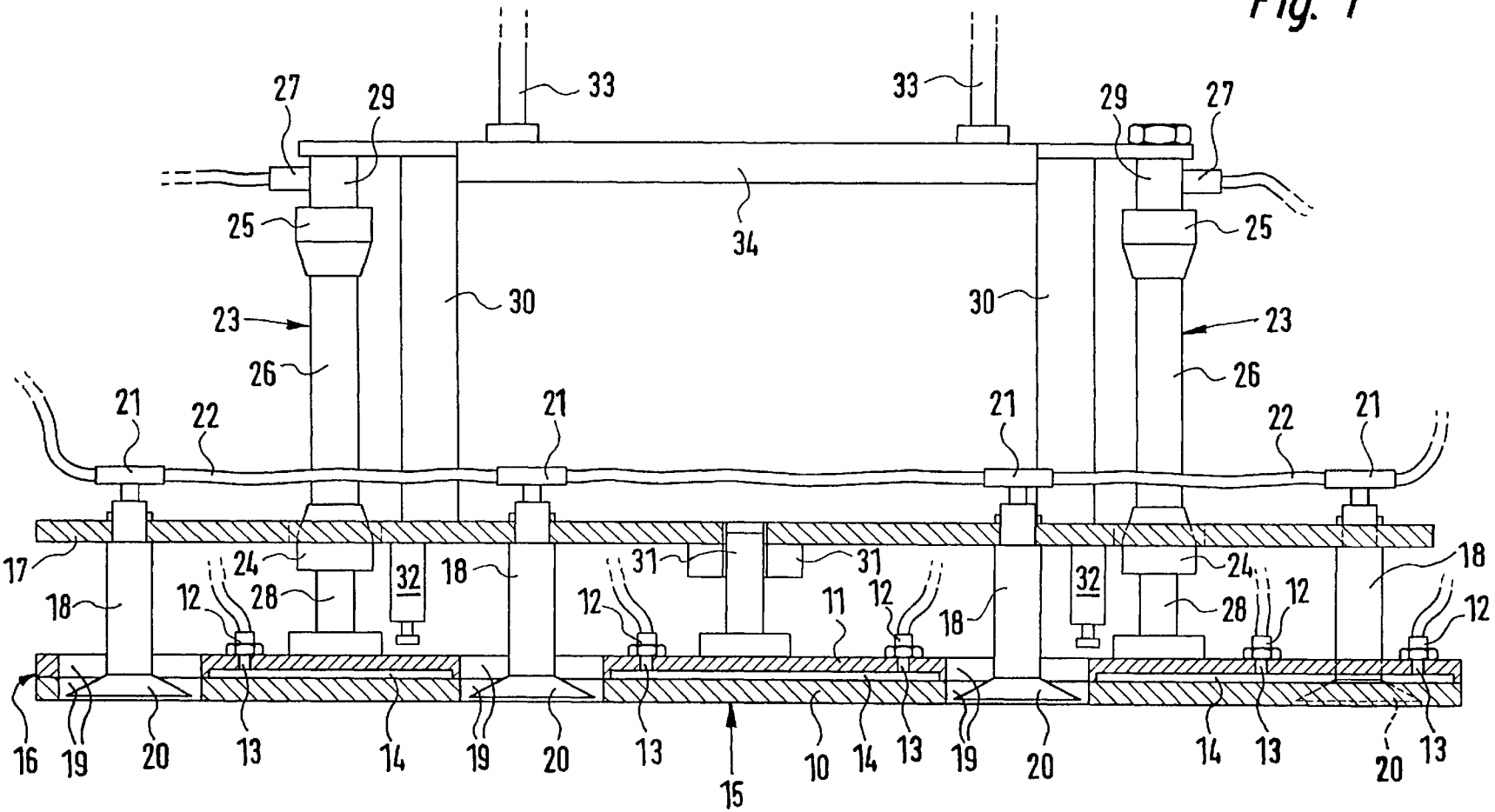
FIG. 1 A vertical cross section of a handling device as one embodiment of the invention FIG. 2 A view of the flat side of a suction pressure supply plate, equipped with recesses, that is connected to a vacuum plate, and FIG. 3 A pressure control device for the positioning means consisting of four contraction elements.
Figure 2:
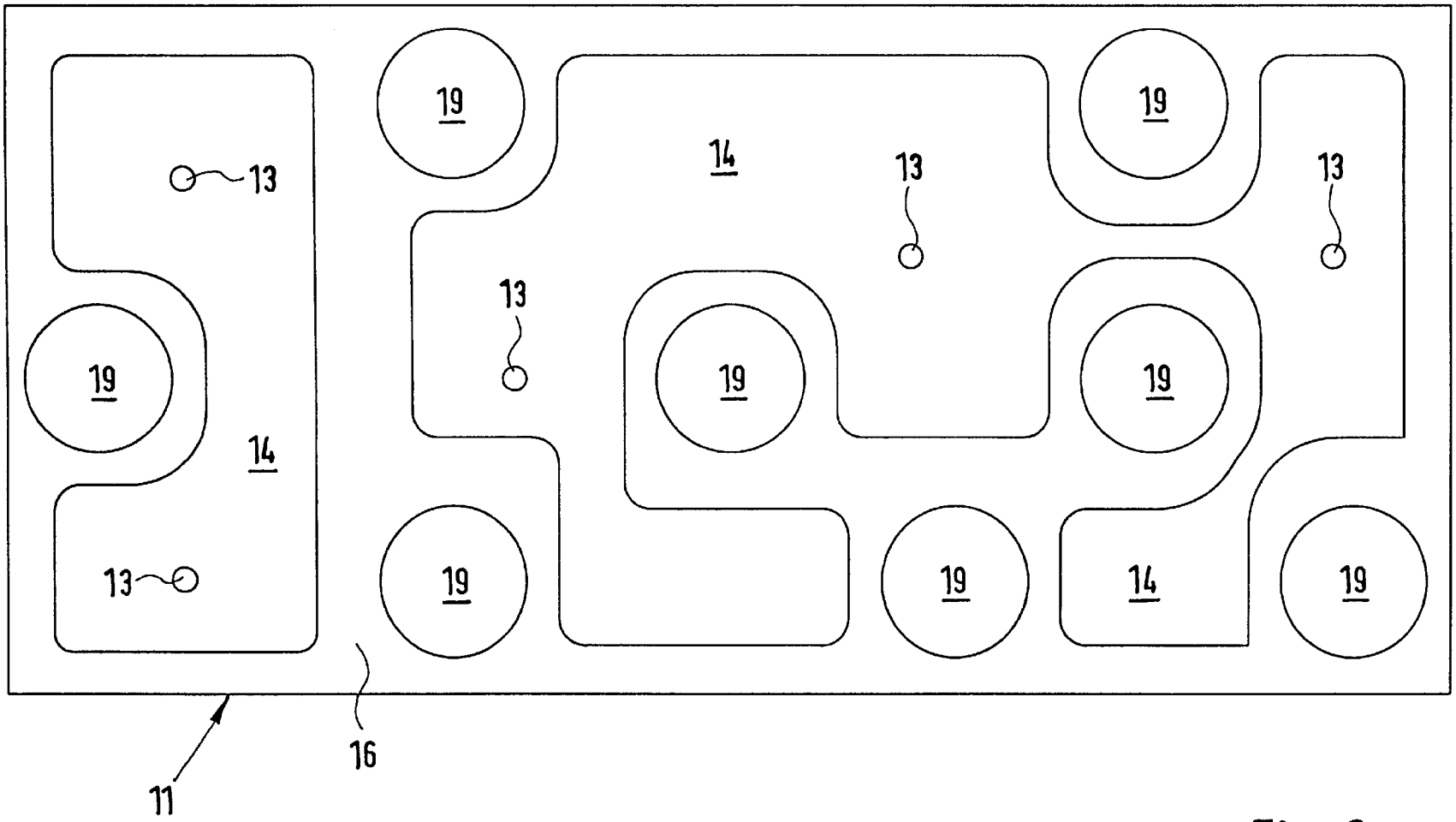

The handling device illustrated as an embodiment in FIG. 1 features a composite plate which consists of a vacuum plate 10 made of a porous, air-permeable material or air-permeable sintered material, and a suction pressure supply plate 11 connected to it. In this regard, the vacuum plate 10 is made of an air-permeable aluminum, for example, like that commercially available under the tradename Metapor. Of course, other metallic, sintered plates can be used just as well. Also, the suction pressure supply plate 11 is made of aluminum, an aluminum alloy, or any other light metal or metal.

The flat side of the suction pressure supply plate 11 facing away from the suction plate 10 is equipped with pneumatic connections 12, which are connected via channels 13 with planar recesses 14 in the opposite flat side of the suction pressure supply plate 11. When connecting the two plates 10, 11, these recesses 14 will form planar cavities, through which the suction pressure applied to the connections 12 can act upon the largest possible surface area of the vacuum plate 10. Thus, a very uniform suction pressure will be applied to the flat side of the vacuum plate 10 (forming vacuum surface 15) that faces away from the suction pressure supply plate 11, in order to lock in place the thin boards being handled. The contact surfaces 16 of the suction pressure supply plate 11 located next to and surrounding the recesses 14 are tightly secured to the vacuum plate 10, with the aid, for example, of suitable adhesive or sealing materials.

As an alternative to this, the recesses 14 can be arranged, in principle, on the vacuum plate 10 or on both plates 10, 11.

A number of vacuum grippers 18 are attached to a retaining plate 17 located parallel to the plates 10, 11. Four of them are illustrated in FIG. 1, with three in the cutting plane and one behind the cutting plane. These suction grippers 18 extend into openings 19, which run in an aligned manner through the suction plate 10 and the suction pressure supply plate 11. Thus, in the position setting illustrated in FIG. 1, there are, at the vacuum end of the vacuum gripper 18, vacuum elements 20 provided within the openings 19, which means that they do not extend beyond the vacuum surface 15 of the vacuum plate 10.

The suction grippers 18 are connected by means of T-joints to the suction pressure line 22, which is used to supply simultaneous suction pressure to the vacuum gripper 18. A corresponding arrangement is also required or provided for the pneumatic connections 12, but is not shown (for simplicity).

The suction pressure supply plate 11 and the retaining plate 17 are connected together by means of four pneumatic actuators designed as contraction members 23. The contraction members 23 each have a contraction tube 26 made of rubbery, elastic material that extends between two head pieces 24, 25. The tube can be subjected to pressure from the inside by an actuating fluid via a pneumatic connector 27. The application of pressure causes a radial expansion of the contraction tube 26, so that a fiber array embedded in the tube body, for example, will cause an axial contraction so that the two head pieces will be pulled together. The resultant change in length of the contraction member 23 can be very accurately defined in accordance with the applied pressure of the actuating fluid.

The lower head pieces 24 of the contraction members 23 are each secured by means of securing elements 28 to the suction pressure supply plate 11, and the upper head pieces 25 are secured by means of securing elements 29—which are also equipped with the pneumatic connectors 27—to L-shaped retaining elements 30 which extend upward, like a gallows, from the retaining plate 17. The contraction elements 23 thus run through associated openings in the retaining plate 17. A control element 31 is provided to control the motion toward and away from each other of the retaining plate 17, on the one hand, and the suction pressure supply plate 11 combined with the vacuum plate 10, on the other hand, so that depending on the requirements and the size of the plate, several control elements 31 can be used. The same also applies to the contraction elements 23, four of which are illustrated in this design embodiment. This number can be varied as well as a function of the control elements 31.

The stop elements 32 are secured to the retaining plate 17 and extend toward the suction pressure supply plate 11; they restrict the movement of the retaining plate 17 against the suction pressure supply plate 11 such that in the stop position, the vacuum elements 20 of the suction gripper 18 will protrude downward past the suction surface 15 so that a particular board can be picked up by them.

A pneumatic or electric positioning device 33 (only the ends of actuating elements, for example, piston rods of pneumatic cylinders, are shown for simplicity) is used for moving and positioning of the entire apparatus. This positioning device 33 engages with a retaining device 34 which is connected with the retaining elements 30 in this embodiment. For example, it can also engage directly with the retaining plate 17 or with another associated apparatus. Due to this positioning device 33, the entire apparatus can be positioned in three dimensions in space, and can even be pivoted or rotated if necessary.

In the positioning illustrated in FIG. 1, the vacuum elements 20 of the suction grippers 18 are retracted into the openings 19, so that the vacuum surface 15 of the suction plate 10 is at the lowest level. Due to suction pressure applied at the pneumatic connections 12, a large-surface vacuum effect will be caused by the vacuum plate 10, so that very thin boards, for example, circuitboards or foils, can be pulled in without damage in order then to handle them together with the entire apparatus by means of the positioning device 33, for example, for positioning or to move them from one workstation to the next.

In order to be able to handle thicker or stiffer boards, the pneumatic connectors 27 of the contraction elements 23 are exposed to an operating pressure, so that they will pull together until the suction pressure supply plate 11 moves into contact with the stop elements 32. Now the vacuum elements 20 of the vacuum grippers 18 project downward past the contact surface 15 of the vacuum plate 10, and due to the application of suction pressure from the suction pressure line 22, a board of this kind can be secured to the vacuum elements 20 in order to be subsequently positioned or transported. The board can be subsequently set down, meaning either the thicker boards or even the thinner boards, at the desired position by increasing the pressure above atmospheric pressure.

Figure 3:
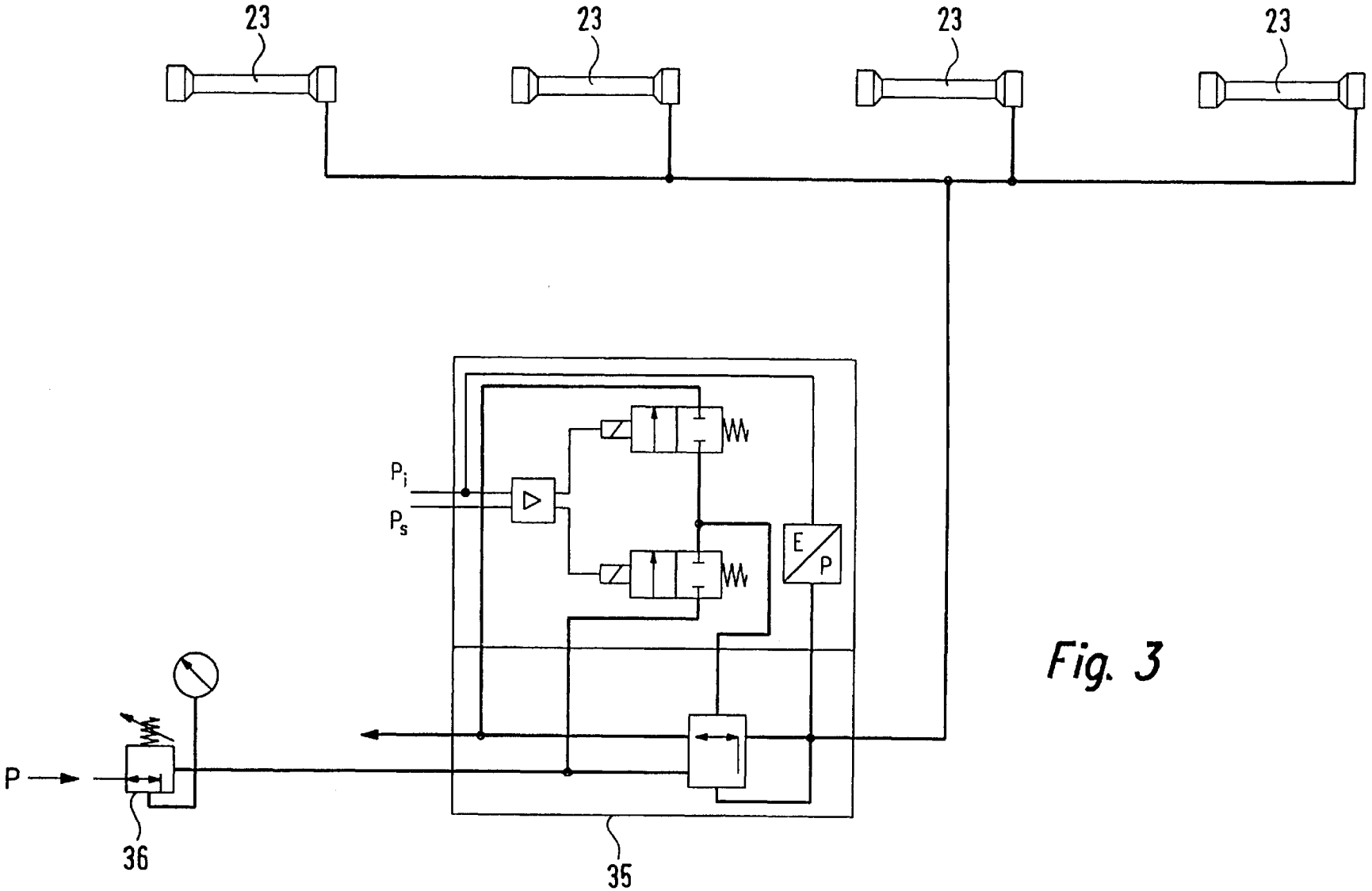

The precise positioning of the contraction elements 23 is effected, according to FIG. 3, by means of pressure applied via a proportional pressure control valve 35. A pressure controller 36 is connected to it. This kind of proportional pressure control valve 35 can be obtained commercially as part MPPES-3-1/8-10-010 from the applicant, for example. Depending on the desired actuator position of the contraction elements 23, a set pressure Ps can be specified, for example, by means of an electrical setpoint module, like that commercially available under designation MPZ-1-24DC SGH-6SW. Thus it will be possible to program in six analog setpoints by means of one integrated potentiometer and to call up each by means of an associated digital input. Control will take place by comparison with the actual pressure value Pi at the output of the proportional pressure control valve 35. Due to this kind of configuration, set positions can be accurately adjusted in the range of 1/10 mm, so that no position indicators are needed for the contraction elements 23.

The contraction elements 23 are suitable for precision positioning of the vacuum plate 10, or of the suction pressure supply plate 11 connected to the vacuum plate 10—regardless of the positioning of the vacuum gripper 28. In this regard, the contraction elements 23 must be in an at least partially contracted state while a rough positioning takes place by means of the positioning device 33. This rough positioning will take place a few mm or 1/10 mm above the thin board or foil to be picked up. By reducing the pressure in the contraction elements 23, there is now a precise lowering of the vacuum plate 10 and positioning up to the board or foil to be handled. Thus, the contraction elements 23 can be equipped with a spring device so that with a reduction in pressure, the extension of the contraction elements 23 will be enhanced or simplified.

Of course, this configuration can be used not only in conjunction with gripper devices, but also in all cases where a board or other article is to be positioned with high accuracy wherein a precision positioning takes place after a rough positioning.

When used for a handling device, other actuators, such as pneumatic or hydraulic adjusting cylinders or electromotor servo-devices can of course be employed instead of the contraction elements 23.

What is claimed is:

1. Handling device, in particular for handling boards and foils, with a number of suction grippers arranged in a plane, characterized in that a suction plate (10) is provided which is made of a porous material or sintered material and to which a suction pressure can be applied, said suction plate being equipped with openings (19) permitting the passage of the suction grippers (18), and in that positioning means (23) are provided by means of which in a first position setting the suction grippers (18) extend beyond the suction surface (15) of the suction plate (10), and by means of which in a second position setting, the suction grippers (18) are moved back into the openings (19) such that they no longer extend beyond the suction surface (15) of the suction plate (10).

2. Handling device according to claim 1, characterized in that control means are provided for supplying suction to the suction plate (10) on the one hand, and to the suction grippers (18) on the other hand, whereby the suction grippers are supplied with suction pressure only in the first position setting.

3. Handling device according to claim 1, characterized in that the suction plate (10) is tightly connected, on the side opposite the suction surface (15), to a suction pressure supply plate (11); said supply plate is provided with at least one suction pressure supply connector (12) and this at least one suction pressure supply connector (12) is connected to at least one planar cavity (14) between the plates (10, 11), and said cavity is formed by a recess in at least one of the plates (11).

4. Handling device according to claim 3, characterized in that the suction pressure supply plate (11) is equipped with the openings (19) for the suction grippers (18) that correspond to those of the suction pressure plate (10).

5. Handling device according to one of the preceding claims, characterized in that the positioning means are designed at least as a pneumatic, variable-position actuator and are located between the suction plate (10) and a retaining device for the suction grippers (18), where said retaining device has, in particular, one retaining plate (17).

6. Handling device according to claim 5, characterized in that the at least one actuator of the positioning means (23) is designed as a contraction element, which has a contraction tube (26) extending between two head pieces (24, 25) and which experiences a length contraction when exposed to internal pressure.

7. Handling device according to claim 5, characterized in that a stop device (32) is provided which limits the movements toward each other of the plates (10, 11) in the direction of the first positioning setting.

8. Handling device according to claim 5, characterized in that a control device (31) is provided to guide the motion of the retaining device relative to the suction plate (10).

9. Handling device according to claim 6, characterized in that for positioning of the actuator or of the actuators of the positioning means (23), a proportional pressure control valve (35) is provided which is connected to the positioning means and which adjusts the internal pressure according to a specified setpoint (Ps).

10. Handling device according to claim 5, characterized in that a positioning device (33) is provided which positions the entire apparatus composed of the at least one or more suction plates (10), the retaining device for the suction grippers (18) and the positioning means (23), and which is designed to implement the positioning movements at least in two directions in space, one of these corresponding to the direction of movement of the positioning means (23).

* * * * *